United States Patent [19]

Spound et al.

[11] 4,102,275

[45] Jul. 25, 1978

[54] ADJUSTABLE MODULAR BOOKCASE

[76] Inventors: Albert M. Spound, Royal Crest Estates 10 Newcastle Dr., Nashua, N.H. 03060; Richard D. Horowitz, 180 Beacon St., Boston, Mass. 02116

[21] Appl. No.: 787,272

[22] Filed: Apr. 13, 1977

[51] Int. Cl.[2] ..... A47B 45/00

[52] U.S. Cl. ..... 108/92; 108/93; 108/102; 312/205

[58] Field of Search ..... 108/93, 102, 114, 92; 312/201, 205, 237

[56] References Cited

U.S. PATENT DOCUMENTS

| | | | |
|---|---|---|---|
| 113,683 | 4/1871 | Mercer | 108/102 |
| 1,069,411 | 8/1913 | Greene | 312/205 X |
| 1,588,771 | 6/1926 | Richardson | 312/201 |
| 2,628,145 | 2/1953 | Slattery | 312/205 |
| 3,916,802 | 11/1975 | Virtue et al. | 108/102 |
| 3,919,950 | 11/1975 | Frazelle et al. | 108/114 |
| 4,025,137 | 5/1977 | Wyler | 108/93 |

*Primary Examiner*—Francis K. Zugel
*Attorney, Agent, or Firm*—Weingarten, Maxham & Schurgin

[57] ABSTRACT

A modular shelf unit capable of assuming a variety of horizontal widths and angular configurations. The aesthetically pleasing shelf unit is formed from two independent upstanding side supports each having a plurality of cantilevered shelves extending therefrom and cooperative with one another to provide an interdigitated, self-supporting shelf unit that is both expandable in the horizontal direction and rotatable about an axis common to each independent side support. The resulting shelf unit is an adjustable, self-supporting structure which is readily adaptable for use in available spaces in homes and offices.

12 Claims, 5 Drawing Figures

Fig. 1.
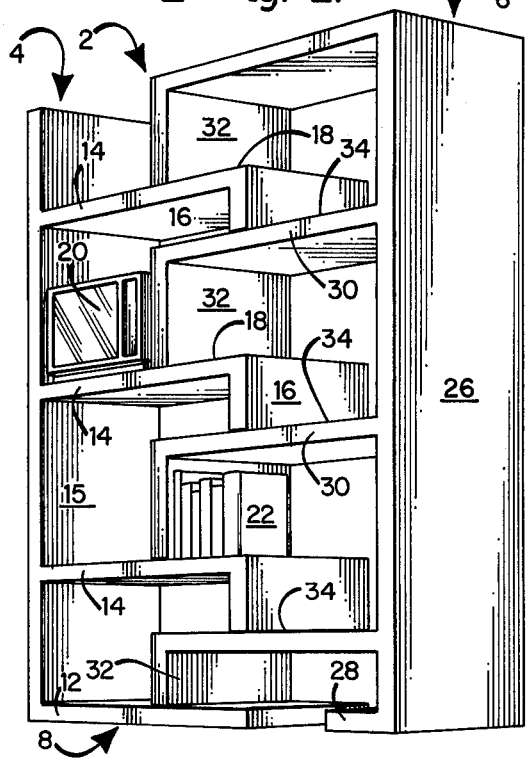
Fig. 2.
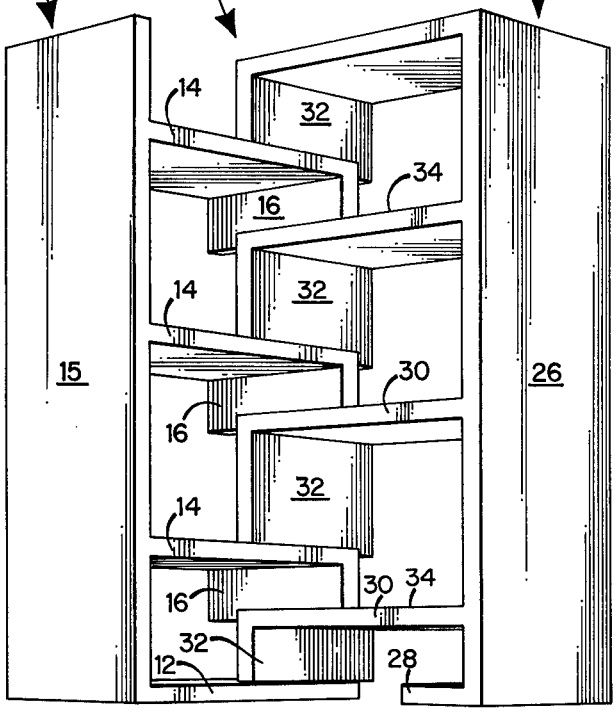
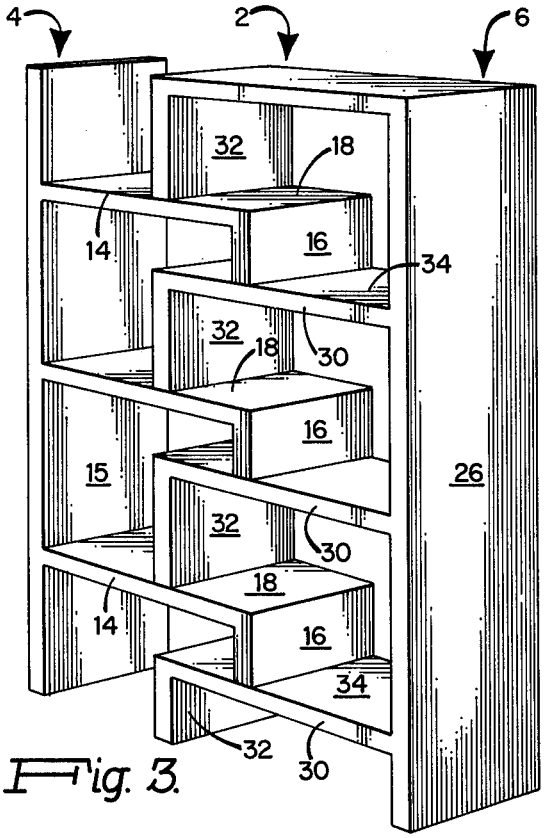
Fig. 3.
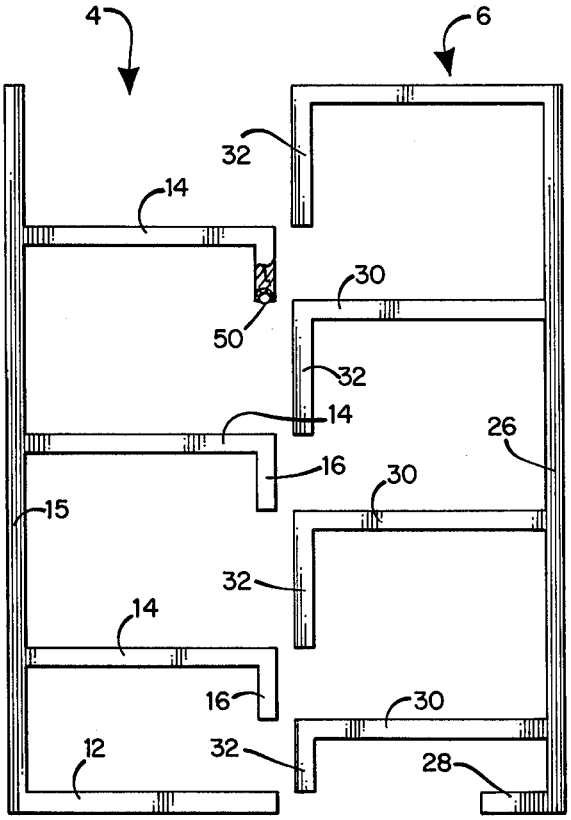
Fig. 4.

ADJUSTABLE MODULAR BOOKCASE

FIELD OF THE INVENTION

This invention relates to shelf units and more particularly to an expandable, self-supporting modular shelf unit.

BACKGROUND OF THE INVENTION

Shelving units, such as bookcases and room dividers, are typically of one-piece, rectangular construction having a base, support sides, a top, and a number of horizontal shelves arranged between the top and base and supported by the sides. In the past, shelves were spaced with respect to one another by either permanently affixing them in a desired position or by providing removable pegs or other supports at various heights along the sides to allow the placement of the shelves in a variety of desired positions. To vary the horizontal dimension of the arranged shelf, it has been necessary to remove or re-position an inner vertical support side and insert a new and distinct shelf of a different desired horizontal length.

For example, in U.S. Pat. No. 3,613,604, there is shown a shelf unit wherein shelf sections of fixed horizontal dimension are positioned at various heights along a wall. In U.S. Pat. No. 3,677,202, there is further shown a storage system having means for retaining shelves of fixed horizontal dimension at various heights and wherein inner vertical support walls may be removed to provide for the support of fixed shelves of a different horizontal dimension. Each of these units exhibit inherent structural limitations that prohibit the expandability and angular displacement of shelves having a predetermined horizontal dimension. U.S. Pat. No. 3,998,170, shows an adjustable wire shelf for frozen foods.

The concept of modular units, and more particularly modular furniture, has evolved to allow a user to individually arrange units in such a way as is most suitable to his or her individual taste, taking into consideration available space. The prior art in providing fixed, non-expandable units wherein the shelves are either permanently or releasably associated with fixed side supports severely limits the possible modular configurations and their adaptation to changing partial conditions.

SUMMARY OF THE INVENTION

The present invention has as a primary object the provisions of a versatile modular shelf unit which is capable of expanding in the horizontal direction and further being angularly disposable to conform to a variety of desired shapes. Broadly speaking, the versatile modular shelf unit of this invention comprises two independent side support sections each having a plurality of spaced cantilevered shelves extending in a substantially horizontal manner therefrom. Each cantilevered shelf of each side support section is configured to cooperate with each corresponding cantilevered shelf of the other side support section to provide an interdigitated, self-supporting shelf unit that is expandable in the horizontal direction and rotatable about an axis common to both sections. The top surface of each shelf is cooperative with a portion of the corresponding shelf of the other side support section to provide self-supporting structural integrity to the completed unit.

The present invention overcomes the limitations of the prior art and offers numerous advantages thereover by providing a shelf unit that may be expandable in the horizontal direction to allow the user to individually determine the width of the desired shelf. Further, the present invention allows the user to angularly position the cantilevered shelves of the first section with respect to the corresponding shelves of the second section. The present invention thus does not suffer the inherent spatial and arrangement limitations of the prior art structures.

DESCRIPTION OF THE DRAWINGS

FIG. 1 is a perspective view of a modular shelf unit constructed in accordance with the teachings of the invention;

FIG. 2 is a perspective view of the shelf unit of FIG. 1 in an expanded angularly disposed condition;

FIG. 3 is a perspective view of an alternative embodiment constructed in accordance to the teachings of the invention;

FIG. 4 is a front view of the shelf unit of FIG. 1 in a separated condition.

DETAILED DESCRIPTION OF THE INVENTION

Figure 5:
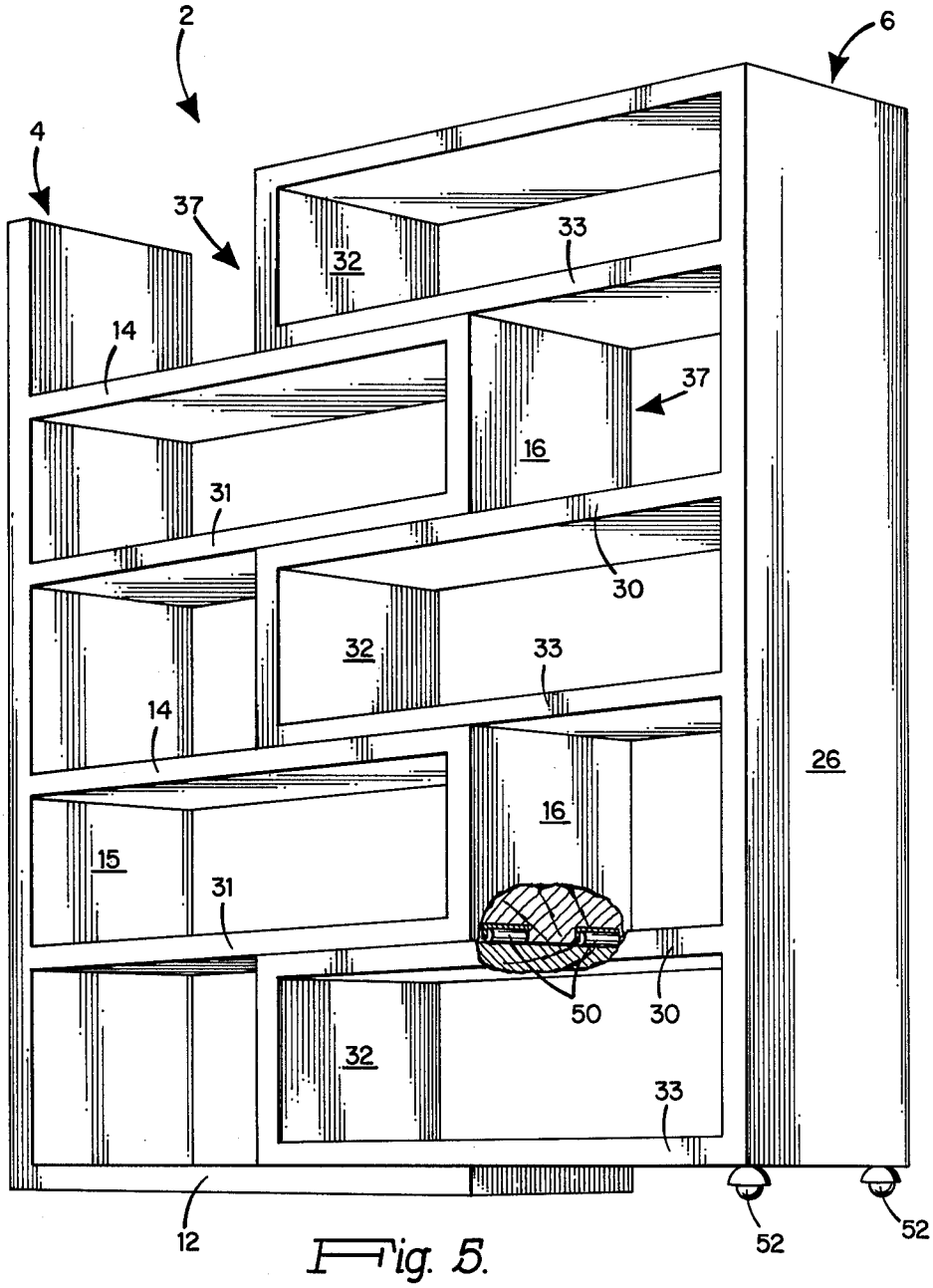
FIG. 5 is a perspective view of an alternative embodiment constructed according to the teachings of the present invention.

With reference now to the drawings and more particularly to FIGS. 1 and 4, there is shown a modular, self-supporting shelf unit 2 constructed according to the present invention. The shelf unit 2 is formed from two distinct support sections 4 and 6, each of which is cooperative with the other in the manner shown to provide interdigitated internal vertical support to the assembled shelf unit. This modular unit is typically formed from wood, plastic, or other suitable material and rests flush on the floor 8.

The first support section 4 comprises an upstanding vertical side 15 having a substantially planar base 12 of predetermined length and extending horizontally inward from the end thereof. Spaced cantilevered shelves 14 extend horizontally inward from side 15 in substantially parallel confronting spaced relation to one another and to base 12. Substantially vertical central supports 16 extend downwardly in parallel relation to side 15 from the end of shelf 14. The upper surface 18 of shelves 14 provides support for holding a variety of desired objects such as a television 20 or books 22. In this embodiment, the shelves and base of support section 4 are of the same horizontal length disposed in parallel spaced relation and lie in the same vertical plane. However, as will be shown below, the relative lengths of the shelves and base may vary if so desired.

A second support section 6 is provided having a vertical side support 26, a base 28 extending horizontally inward from the end thereof, and a plurality of spaced cantilevered shelves 30 horizontally extending inward from side support 26. The cantilevered shelves 30 each have a central support 32 extending downwardly from the end thereof in substantially parallel relation to side support 26. Generally, shelves 30 are of the same horizontal length which is normally greater than the horizontal length of base 28. Like the upper surface 18 of shelves 14, the surface 34 of shelves 30 provides the support for any number of objects or knick-knacks.

As may be readily appreciated from the drawings, the shelves of support sections 4 and 6 are disposed in overlapping, interdigitated relation to one another to form a self-supporting, expandable shelf support. Shelves 14 are intermeshed with corresponding shelves 30 such that the upper surface 34 of shelves 30 provide vertical support to the central support 16 of corresponding shelves 14. Likewise, the upper surface 18 of shelves 14 provide vertical support to the central support 32 of shelf 30. The central supports of each section are horizontally slidable on their respective supporting shelves. Roller bearings 50 or other suitable associated sliding means may be provided on the ends of central supports 16 and 32 to facilitate slidable movement of the central support on the confronting supporting shelf. One central support 16 in FIG. 4 has been broken away to illustrate one roller bearing 50, but it is understood that similar bearings may be installed in each of the central supports 16 and 32. When such bearings are used, suitable clearances are provided at the lowermost ends of the respective central supports to allow the roller surface of bearing 50 to project slightly for smooth operation. The resulting structure provides a shelf unit that is internally self-supported irrespective of the expandable horizontal width of the shelves. Unlike the prior art, the width of each shelf may be expanded or contracted without the necessity for removal of an internal vertical support structure and the subsequent introduction of a separate shelf of a different width. This novel construction further allows angular disposition of one section with respect to the other to provide a shelf support unit that is readily adaptable for disposition against a nonplanar surface. For example, FIG. 2 shows the shelf-support unit of FIG. 1 in a further expanded, angularly disposed condition.

The horizontal lengths of the shelf and base of each section may vary according to desired design specifications so long as the shown interdigitated support is provided. The central supports 16 and 32 may extend not only from the end of the shelf as shown, but may also extend from any point along the length thereof. The central supports are shown to extend from the end of the respective shelves, and the shelves 14 and 30 are shown of the same horizontal length so as to maximize the expandability of the unit. The central support is shown in the drawing to extend downwardly from the shelf; however, the interdigitated support may be accomplished in a manner wherein the central support extends upwardly from the shelf to slidably support the corresponding shelves. For example, in FIG. 4, central supports 16 and 32 could extend upwardly from shelves 14 and 30 to provide slidable support to the lower surfaces of corresponding shelves of each section.

The lowermost shelf of the second section 6 is supported in a substantially parallel spaced relation from floor 8 by central support 32. In FIG. 1, the central support is slidably supported by base 12. However, the base 10 and base 28 may be removed as shown in FIG. 3 in the situation where a bottom shelf is not desirous. In this embodiment, the central support of the lowermost shelf of the second section extends to the floor to provide the necessary vertical support. Another alternative embodiment of the present invention is shown in FIG. 5 wherein auxiliary shelves 31 and 33 are provided between the end portions of central supports 16 and 32 and respective confronting side supports 15 and 26 to form multiple shelf units 37. Shelves 31 and 33 add further support and structural integrity to shelves 14 and 30 while simultaneously providing additional horizontal shelves. To facilitate horizontal movement of the units 4 and 6, roller bearing 50 may be provided on the lower surface of shelves 31 and 33, and casters 52 may be provided at the end of side support 6. It should be noted that side support 6 is appropriately shortened such that when casters 52 are added, the shelves remain horizontally disposed with respect to the floor.

Various other modifications and alternative implementations can be made without departing from the true scope of the invention. Accordingly, it is not intended to limit the invention by what has been particularly shown and described, except as indicated in the appended claims.

What is claimed is:

1. An adjustable, self-supporting, modular shelf unit adapted to stand on a horizontal floor comprising:

first and second shelf sections each comprising:

a single substantially upstanding side support;

a plurality of spaced horizontal shelves each extending inwardly from the respective side supports;

a central support extending substantially vertical from each of said spaced horizontal shelves;

each horizontal shelf of said first section disposed in vertical, offset, interdigitated, meshed relation to each horizontal shelf of said second section;

said first and second shelf sections being movable inwardly and outwardly with respect to one another in the horizontal plane;

the upper surface of each shelf of each section providing vertical support to the confronting central support of the other section;

the outer end of each central support of said first section being slidable on the confronting surface of the corresponding shelf of said second section;

the outer end of each central support of said second section being slidable on the confronting surface of the corresponding shelf of said first section;

means for supporting the lowermost shelf of said adjustable, self-supporting, modular shelf unit in substantially parallel relationship to said floor.

2. An adjustable, self-supporting, modular unit according to claim 1 wherein each central support of said first and second sections extends downwardly from each of said spaced horizontal shelves.

3. A modular unit according to claim 1 wherein said first shelf section includes a planar base extending horizontally inward from the lower end of said upstanding side support; and wherein said means for supporting the lowermost shelf comprises a substantially vertical central support extending downwardly from said lowermost shelf and slidably supported on said base of said first section.

4. An adjustable modular unit according to claim 1 wherein said means for supporting said lowermost shelf comprises a substantially vertical central support extending downwardly from said shelf and slidably supported on said floor.

5. An adjustable modular unit according to claim 3 wherein said second shelf unit includes a substantially planar base extending horizontally inward from the lower end of said vertical side support.

6. An adjustable modular unit according to claim 5 wherein the horizontal length of said base of said first section is greater than the horizontal length of said base of said second section.

7. An adjustable modular unit according to claim 1 wherein each central support of said first and second shelf sections includes associated sliding means for providing easy slidable movement of said central supports on said confronting surfaces of said corresponding shelves.

8. An adjustable modular unit according to claim 1 wherein said side supports of said second section include associated sliding means for providing easy slidable movement of said vertical support on said floor.

9. An adjustable modular shelf unit according to claim 1 wherein said first and second shelf sections each include at least one auxiliary, horizontal shelf extending outwardly from each respective central support and affixed to each respective side support.

10. An adjustable modular shelf unit according to claim 9 wherein the auxiliary horizontal shelf of said first section is slidable on the confronting surface of the corresponding shelf of said second section and the auxiliary horizontal shelf of said second section is slidable on the confronting surface of the corresponding shelf of said first section.

11. An adjustable modular shelf unit according to claim 10 wherein said auxiliary shelf of said first and second sections each include associated sliding means for providing easy slidable movement on said confronting surfaces.

12. An adjustable modular shelf unit according to claim 9 wherein the lower end of said side support of said second section includes casters for providing easy slidable movements of said support on said floor.

* * * * *